US008196677B2

(12) United States Patent
Montgomery

(10) Patent No.: US 8,196,677 B2
(45) Date of Patent: Jun. 12, 2012

(54) HORIZONTAL DRILLING SYSTEM

(75) Inventor: Michael E. Montgomery, Camby, IN (US)

(73) Assignee: Pioneer One, Inc., Mooresville, IN (US)

( * ) Notice: Subject to any disclaimer, the term of this patent is extended or adjusted under 35 U.S.C. 154(b) by 281 days.

(21) Appl. No.: 12/535,541

(22) Filed: Aug. 4, 2009

(65) Prior Publication Data

US 2011/0031018 A1 Feb. 10, 2011

(51) Int. Cl.
*E21B 44/00* (2006.01)

(52) U.S. Cl. ..... 175/24; 175/61; 175/73

(58) Field of Classification Search ..... 175/24, 175/26, 61, 62, 73, 75; 173/74, 78, 79, 141, 173/152

See application file for complete search history.

(56) References Cited

U.S. PATENT DOCUMENTS

| | | | | |
|---|---|---|---|---|
| 3,307,639 | A | | 3/1967 | Wilder et al. |
| 3,327,790 | A | | 6/1967 | Vincent et al. |
| 3,712,387 | A | | 1/1973 | Vincent et al. |
| 3,946,819 | A | | 3/1976 | Hipp |
| 4,084,646 | A | | 4/1978 | Kurt |
| 4,440,244 | A | | 4/1984 | Wiredal |
| 4,474,252 | A | * | 10/1984 | Thompson ..... 175/69 |
| 4,487,274 | A | | 12/1984 | Hurt |
| 4,509,606 | A | | 4/1985 | Willis |
| 4,530,408 | A | | 7/1985 | Toutant |
| 4,694,913 | A | | 9/1987 | McDonald et al. |
| 4,858,703 | A | | 8/1989 | Kinnan |
| 4,867,255 | A | | 9/1989 | Baker et al. |
| 4,907,658 | A | | 3/1990 | Stangl et al. |
| 4,928,775 | A | | 5/1990 | Lee |
| 4,947,944 | A | | 8/1990 | Coltman et al. |
| 5,002,138 | A | | 3/1991 | Smet |
| 5,004,382 | A | | 4/1991 | Yoshino |
| 5,010,965 | A | | 4/1991 | Schmelzer |
| 5,014,796 | A | | 5/1991 | Gustafsson |
| 5,052,503 | A | | 10/1991 | Lof |
| 5,107,944 | A | | 4/1992 | Gustafsson |
| 5,119,891 | A | | 6/1992 | Flynn |
| 5,139,086 | A | | 8/1992 | Griffith, Sr. |
| 5,139,095 | A | | 8/1992 | Lyon et al. |

(Continued)

FOREIGN PATENT DOCUMENTS

| | | |
|---|---|---|
| BE | 865954 | 7/1978 |

(Continued)

OTHER PUBLICATIONS

Incorporating Trenchless Technology Guidelines & Standards into State Road Authority Requirements, R. Grove, Main Roads Western Australia, nine pages.

*Primary Examiner* — William P Neuder
*Assistant Examiner* — Richard Alker
(74) *Attorney, Agent, or Firm* — Barnes & Thornburg LLP

(57) ABSTRACT

A horizontal direction drilling system comprises a power pack coupled to a source of compressed air and a water reservoir and forms a mixture of compressed air, water, and oil. The horizontal direction drilling system further comprises a steerable horizontal drill. The steerable horizontal drill includes an air powered reciprocating hammer, and a drill head. The steerable horizontal drill receives the mixture to power the reciprocating hammer. The drill head includes a drill face and the mixture exits the steerable horizontal drill through the drill face.

16 Claims, 12 Drawing Sheets

U.S. PATENT DOCUMENTS

| | | | | | |
|---|---|---|---|---|---|
| 5,205,363 | A | | 4/1993 | Pascale | |
| 5,249,635 | A | | 10/1993 | King et al. | |
| 5,288,173 | A | | 2/1994 | Jenne et al. | |
| 5,386,878 | A | | 2/1995 | Rowekamp | |
| 5,449,046 | A | | 9/1995 | Kinnan | |
| 5,490,569 | A | | 2/1996 | Brotherton et al. | |
| 5,607,280 | A | | 3/1997 | Rozendaal | |
| 5,680,904 | A | | 10/1997 | Patterson | |
| 5,695,014 | A | * | 12/1997 | Jenne | 175/21 |
| 5,715,897 | A | | 2/1998 | Gustafsson | |
| 5,722,496 | A | | 3/1998 | Connell et al. | |
| 5,778,991 | A | | 7/1998 | Runquist et al. | |
| 5,785,995 | A | | 7/1998 | Daisy, Jr. et al. | |
| 5,795,991 | A | | 8/1998 | Hesse et al. | |
| 5,803,187 | A | | 9/1998 | Javins | |
| 5,875,858 | A | * | 3/1999 | Brady | 175/68 |
| 5,876,152 | A | | 3/1999 | Hesse | |
| 5,890,540 | A | | 4/1999 | Pia et al. | |
| 5,899,283 | A | | 5/1999 | Cox | |
| 5,937,954 | A | | 8/1999 | Puttmann et al. | |
| 5,975,221 | A | | 11/1999 | Puttmann | |
| 6,012,536 | A | | 1/2000 | Puttmann et al. | |
| 6,021,856 | A | | 2/2000 | Pascale | |
| 6,148,935 | A | | 11/2000 | Wentworth et al. | |
| 6,257,353 | B1 | | 7/2001 | Belew et al. | |
| 6,357,537 | B1 | | 3/2002 | Runquist et al. | |
| 6,454,025 | B1 | | 9/2002 | Runquist et al. | |
| 6,588,516 | B2 | | 7/2003 | Runquist et al. | |
| 6,659,202 | B2 | | 12/2003 | Runquist et al. | |
| 7,025,152 | B2 | | 4/2006 | Sharp et al. | |
| 7,093,671 | B2 | | 8/2006 | Puttmann | |
| 7,093,677 | B2 | | 8/2006 | Hofmann et al. | |
| 7,111,695 | B2 | | 9/2006 | Puttmann | |
| 7,182,151 | B2 | | 2/2007 | Stump et al. | |
| 7,318,491 | B2 | | 1/2008 | Reil | |
| 2007/0137897 | A1 | * | 6/2007 | Sanders et al. | 175/61 |

FOREIGN PATENT DOCUMENTS

| | | |
|---|---|---|
| DE | 28 47 128 | 5/1980 |
| DE | 44 32 710 | 4/1996 |
| EP | 0 343 800 | 11/1989 |
| EP | 0 467 642 | 1/1992 |
| EP | 0 806 543 | 11/1997 |
| EP | 0 857 853 | 8/1998 |
| EP | 0 984 132 | 3/2000 |
| EP | 0 994 235 | 4/2000 |
| JP | 7-259481 | 10/1995 |
| WO | WO 96/11323 | 4/1996 |
| WO | WO 97/46739 | 12/1997 |
| WO | WO 99/19596 | 4/1999 |
| WO | WO 00/11303 | 3/2000 |
| WO | WO 00/47860 | 8/2000 |
| WO | WO 00/52294 | 9/2000 |
| WO | WO 00/55467 | 9/2000 |

* cited by examiner

HORIZONTAL DRILLING SYSTEM

BACKGROUND OF THE INVENTION

The present disclosure is related to a method and apparatus of horizontal drilling through earthen barriers. More specifically, the present disclosure is related to horizontal drilling through earthen barriers using a steerable drilling apparatus having a hammer drill powered by a mixture of air, oil, and water.

Underground bores that are oriented in a horizontal direction are used to route utilities through underground impediments such as rock structures. For example, an underground bore may be used to form a path for a utility line under a river bed. For example, U.S. Pat. No. 4,474,252 discloses an impact hammer positioned on the end of a rotating drill pipe. The air hammer is powered by compressed air which is mixed with lubricant to lubricate the hammer and water to flush the cuttings. The drill pipe is rotated at the machine and the mixture of air and water is produced at the machine with the mixture being introduced through a swivel connection to accommodate the introduction of the mixture into the rotating drill pipe.

U.S. Pat. No. 7,111,695 discloses pneumatic rock-boring device which is fed air and/or water through a single media channel allowing the device to be used with strings of drill pipe. The rock-boring device of U.S. Pat. No. 7,111,695 can be turned by the boring machine in a manner similar to the method used in the U.S. Pat. No. 4,474,252 to effect traditional drilling. Alternatively, the impact hammer may reciprocate thereby allowing the chisel to work material in contact with the rock-boring device. U.S. Pat. No. 7,111,695 also discloses that the rock-boring device may rotate while the chisel reciprocates.

U.S. Pat. No. 3,712,388 discloses a down-hole air hammer drill attached to rotatable drill pipe. The hammer drill of U.S. Pat. No. 3,712,388 has an air exhaust system that exhausts above the bit in the down hole to remove cuttings. The down-hole air hammer drill is used on a lower string of a drill pipe which rotated while the air hammer drill operates.

U.S. Pat. No. 6,659,202 discloses a steerable horizontal directional drilling system that rotates a fluid hammer and drill bit relative to the drill string. The drill head is continuously rotated relative to the drill string via a mud motor. The drill string is held stationary while the working end of the apparatus is rotated during the hammering to form the horizontal bore.

SUMMARY OF THE INVENTION

The present application discloses one or more of the features recited in the appended claims and/or the following features which, alone or in any combination, may comprise patentable subject matter:

A horizontal direction drilling system comprises a power pack coupled to a source of compressed air and a water reservoir. The power pack includes a controller, an air flow valve coupled to the controller, an oiler driven by compressed air, and an air driven pump. The air flow valve is operable to control the flow of compressed air from the source of compressed air. The oiler is operable to inject a predetermined quantity of lubricant into the flow of compressed air. The pump is operable to inject a quantity of water from the water reservoir into the flow of compressed air. The air, oil, and water form a mixture. The controller is operable to vary the flow of compressed air through the power pack. The horizontal direction drilling system further comprises a steerable horizontal drill. The steerable horizontal drill includes an air powered reciprocating hammer, and a drill head. The steerable horizontal drill receives the mixture to power the reciprocating hammer. The drill head includes a drill face and the mixture exits the steerable horizontal drill through the drill face.

In some embodiments, the system further includes a remote control transmitter and the power pack further includes a remote control receiver to receive control instructions from the remote control to vary the operation of the power pack.

In some embodiments, the air flow valve comprises a ball valve.

In some embodiments, the steerable drill comprises a back body and a connector coupling the back body to the hammer.

In some embodiments, the mixture flows through the back body to the hammer.

In some embodiments, the back body has a longitudinal axis and the hammer has a longitudinal axis, and the connector includes an offset. The offset is oriented such that when the connector is coupled to the back body and the hammer, the longitudinal axis of the back body forms an acute angle with the hammer. In some embodiments, the acute angle is an angle of about two degrees. In other embodiments, the acute angle may be larger or smaller than about two degrees.

In some embodiments, the steerable drill further comprises position transmitter housing positioned in the back body.

In some embodiments, the mixture flows through the back body to the hammer.

In some embodiments, the drill head includes a drill bit and the drill face is on the drill bit. In such embodiments, the drill bit if formed so that a portion of the drill face is generally perpendicular to the longitudinal axis of the hammer and a first portion of the drill face extends away from the longitudinal axis of the hammer a distance greater than a second portion of the drill face so that the drill face is offset from the hammer.

In some embodiments, the drill face has a maximum dimension from the longitudinal axis of the hammer that is greater than a cross-sectional radius of the hammer.

In some embodiments, the position of a maximum offset dimension of the drill face, a point defined by the intersection of the longitudinal axis of the hammer and the longitudinal axis of the back body, and the orientation of a position transmitter positioned in the housing are all keyed such that the orientation of the position transmitter is indicative of the position of the offset drill face.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
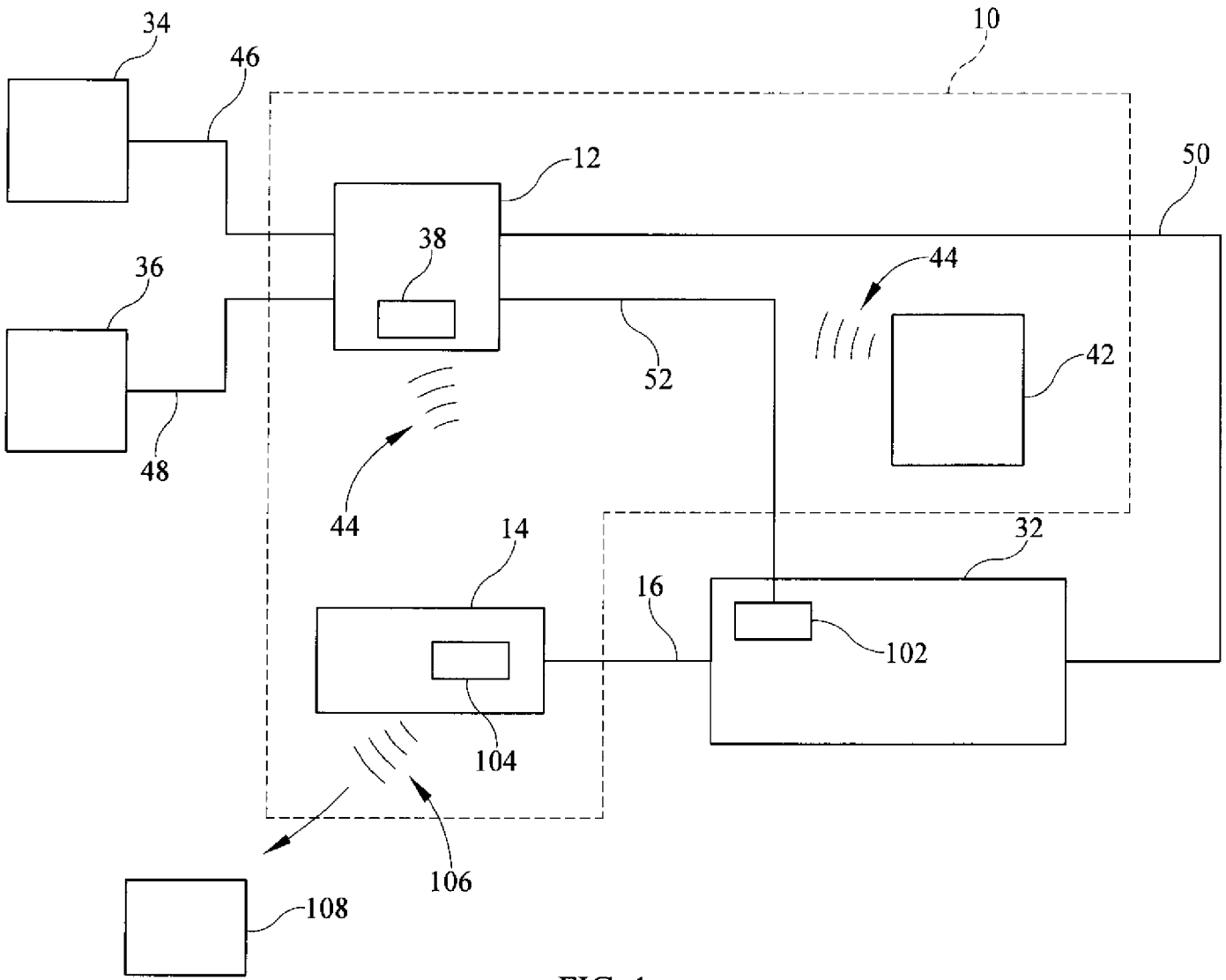
FIG. 1 diagrammatic view of a horizontal drilling system according to the present disclosure.

A horizontal drilling system 10 for drilling a horizontal bore includes a power pack 12 and a drill 14 as shown diagrammatically in FIG. 1. The drill 14 is configured to be attached to the front of a drill string 16 of a standard horizontal drilling machine 32 such as the model D9x13 Series II horizontal drilling machine available from Vermeer of Pella, Iowa, for example. The drill 14 is a steerable device which permits a user to rotate the drill string 16 to guide the direction of the drill 14 while the drill 14 forms bore 98 through the ground 100 or other structure.

The drill 14 comprises drill body 24 and a bit 22 driven by a hammer 18 within the drill body 24 to work the ground and displace worked material. The power pack 12 is a remotely controlled to operate the hammer 18. As will be discussed in further detail below, the drill 14 receives a mixture of compressed air and water which are mixed by the power pack 12 with a lubricant and delivered to the bit 22 through the compressed air structure on the horizontal drilling machine, drill string 16, and drill body 24. As will be explained in further detail below, the flow of the mixture passes through the actuation mechanisms of the hammer 18 to cause the bit 22 to reciprocate and work ground with the mixture exiting the face of the bit 22 to clear cuttings away from a bit face 30 of the bit 22. The action of the hammer 18 along with the removal of cuttings and the configuration of the bit face 30 results in rapid progression of the drill 14 through homogeneous earthen structures such as limestone. This reduces wear on the horizontal drilling equipment because the drill string 16 does not have to be turned during operation other than to steer the drill 14 through the ground. The steering feature of the drill 14 permits routing the horizontal bore formed by the drill 14 along a closely controlled route to both reduce non-linearity in the bore and control the length of the bore necessary.

FIG. 1 shows the diagrammatic relationship of the horizontal drilling system 10 to the horizontal drilling machine 32. The power pack 12 is fed a supply of compressed air from a compressor 34. Typically a supply of about 900 cubic feet per minute at 350 pounds per square inch is sufficient to operate the horizontal drilling system 10. A supply of water is available to the power pack 12 via a water reservoir 36. Because the power pack 12 utilizes the energy of the compressed air operate a water pump 84 (shown diagrammatically in FIG. 2), the water reservoir does not have to be pressurized. The power pack 12 meters the water and compressed air with a metered amount of lubricant from a lubricant reservoir 40 resident on the power pack 12 to form the mixture. The mixture travels through a conduit 50 to the horizontal drilling machine 32. The mixture is conveyed to the drill 14 through the compressed air distribution system of the horizontal drilling machine 32 and the drill 16 as is well known in the art.

An operator controls the operation of the power pack 12 through the radio transmitter 42 which communicates with a radio receiver 38 of the power pack 12 via a radio signal 44. The operator can signal the power pack 12 to engage to provide the mixture to the horizontal drilling machine 32 to activate the hammer 18 of the drill 14. Additional controls are available to the operator as will be discussed in detail below.

The power pack 12 receives 12 volts of power from an external power source such as a battery on the compressor 34 or a battery on the horizontal drilling machine 32. In the illustrative embodiment, a cable 52 is connected to the battery 102 of the horizontal drilling machine 32. In other embodiments, the power pack 12 may include a separate battery. In still other embodiments, the power pack 12 may include a separate generator to generate power for operation of the electrical components of the power pack 12.

The mixture is fed through the compressed air delivery system of the horizontal drilling machine 32 and through the drill string 16 to the drill 14. The mixture comprises about 98% air with about 1.5% water and 0.5% oil. Both the air and water exit the bit face 30 of the bit 22. Relief in the bit face 30 of the bit 22 allows the water and air to escape and drive cuttings along the drill body 24 and the drill string 16 to exit the bore. The mixture also serves to cool and lubricate the bit 22 to permit extended operation of the drill 14.

A sonde 104 may be positioned in a back body 20 of the drill body 24 to send a radio signal 106 that relates both the position and the orientation of the drill 14 to a receiver 108 on the surface above the bore 98. Because the sonde 104, when installed, is keyed to the drill body 24 and the radio signal 106 indicates a relationship of the sonde 104 relative to gravity, an operator can determine the orientation of the drill 14 to determine which direction the drill 14 is drilling to steer the drill 14 during operation. If a change in direction is required, the operator rotates the drill string 16 utilizing the horizontal drilling machine 32 to turn the drill body 24 of the drill and change direction of travel of the drill 14.

Figure 2:
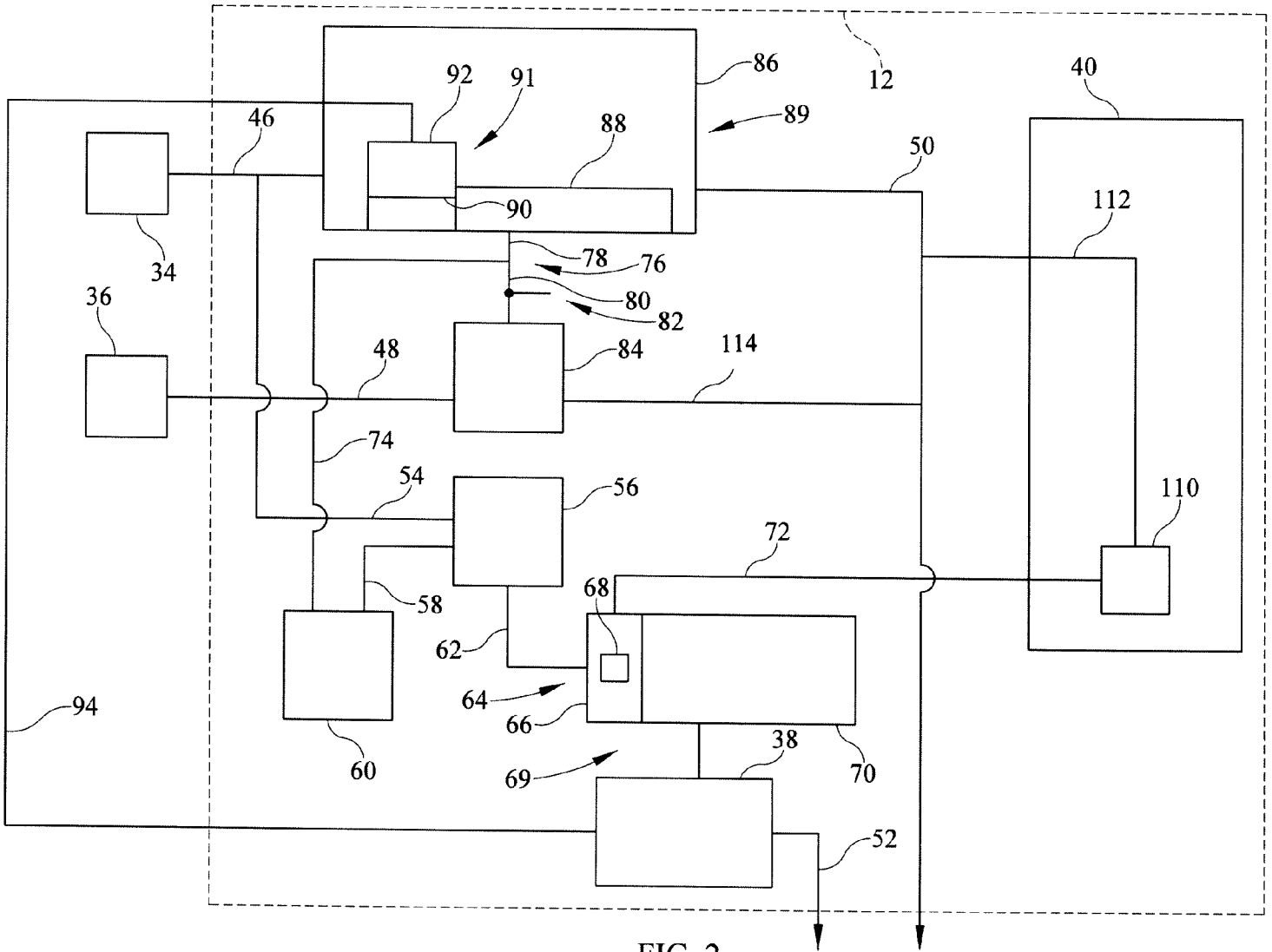
FIG. 2 is a diagrammatic representation of a power pack of the horizontal drilling system of FIG. 1.

A schematic of the power pack 12 is shown in FIG. 2. As described above, the power pack 12 receives power for the electrical system of the power pack 12 through a cable 52. The electrical system of the power pack 12 includes only low voltage components which require minimal power. The radio receiver 38 includes control circuitry which controls the operation of an oiler 69 and a solenoid 92 which controls the flow of compressed air through the power pack 12. All other components of the power pack 12 are operated on compressed air.

The compressor 34 supplies compressed air through a conduit 46 which connects to a ball valve 86 which will be discussed in further detail below. A conduit 54 taps the conduit 46 to communicate the air from the compressor 34 to a pressure regulator 56 which regulates the compressed air down from 350 pounds per square inch to approximately 220 pounds per square inch. In the illustrative embodiment, the regulator 56 is a standard Underwriter's Laboratories listed high pressure regulator available from Holte Manufacturing of Eugene., Oreg. The pressure regulator 56 has two outputs including an output through a conduit 58 to a combination pressure regulator/filter 60 which further regulates the compressed air down to approximately 120 pounds per square inch. In the illustrative embodiment, the pressure regulator/filter 60 is a model 06E2413AC available from Parker Hannifin of Cleveland, Ohio.

The pressure regulator 56 has a second output which communicates regulated air through a conduit 62 to a flow control 64 which includes a valve assembly 66 and a solenoid 68 of the oiler 69. The oiler 69 includes a controller 70 which operates the solenoid 68 to control the flow of air through a conduit 72 to a positive displacement pump 10 positioned in the lubricant reservoir 40 . The positive displacement pump 110 is adjustable to vary the output of pressurized air therethrough. The output of the positive displacement pump 112 multiplies the pressure of the air delivered through conduit 72 to a higher pressure to meter and output lubricant from the reservoir 40 through a conduit 112. The controller 70 receives power from the radio receiver 38 through a cable 96. The controller 70 operates in both an automatic mode and a manual mode and includes a variably adjusted rate control to control rate at which the flow control 64 allows air to flow to the positive displacement pump 110 to thereby meter the lubricant transferred through conduit 112. In the illustrative embodiment, the oiler 69 is available as a complete unit from Holte Manufacturing Company, Inc. In the illustrative embodiment, the ratio of the positive displacement pump 110 is set to multiply the incoming air pressure by about three times to provide a lubricant output pressure of approximately 660 pounds per square inch.

The combination pressure regulator/filter 60 receives the pressurized air from conduit 58, filters the air, and regulates the pressure down to an output of approximately 130 pounds per square inch which is communicated, via a conduit 74, to a t-joint 76 that transmits the air through a conduit 78 to a flow control assembly 89 which includes an actuator 88 which controls the operation of the ball valve 86 of the control assembly 89. The actuator 88 is air powered with the operation of the actuator 88. The flow control assembly 89 further includes a valve assembly 91 that includes a valve 90 operated by a solenoid 92. The solenoid 92 is powered and controlled by the radio receiver 38 which communicates with the solenoid 92 through a cable 94. When the solenoid 92 is energized, the valve 90 allows air from conduit 78 to act on the actuator 88 which opens the ball valve 86 to allow compressed air to flow from conduit 46 to conduit 50 and the drill 14. In the illustrative embodiment, the flow control assembly 89 is a model A2S-75-10V available from SVF Flow Controls, Inc. of Santa Fe Springs, Calif.

The t-joint 76 also transfers the air from conduit 74 to a conduit 80 which includes a manually actuable valve 82. The conduit 80 communicates the air at 120 pounds per square inch to an air powered water pump 84. The air powered water pump 84 is in communication with the water reservoir 36 and receives water through a conduit 48. The air powered water pump 84 is powered by the compressed air from conduit 80 to draw water from the reservoir 36 and transfer a metered amount of water through a conduit 114 to the conduit 50. The flow of air through air powered water pump 84 may be manually adjusted by adjusting the position of the manually actuable valve 82 which controls the size of an orifice in the conduit 80 to restrict the flow to the air powered water pump 84. In some embodiments, the flow of air may be controlled by a solenoid activated valve which operates similarly to valve assembly 91 to turn on the flow of water to the conduit 114 when the ball valve 86 is opened.

The conduit 112 communicates to the conduit 50 to input lubricant into the flow traveling through conduit 50. Similarly, the conduit 114 communicates to the conduit 50 to input water into the flow traveling through conduit 50. By adjusting the oiler 69 and the manually actuable valve 82, the amount of lubricant and water can be respectively controlled to control the proportions in the mixture flowing through conduit 50. Because the total flow of water and lubricant is minimal relative to the flow of compressed air during operation of the horizontal drilling system 10, it is permissible for the air powered water pump 84 to provide a flow of water to the conduit 114 and the oiler 69 provide lubricant to the conduit 112 when ball valve 86 is closed as the excess water and lubricant is immediately flushed from the conduit 50 once the ball valve 86 is opened.

During operation of the horizontal drilling system 10, an operator adjusts the oiler 69 and manually actuable valve 82 to provide the proper mixture of compressed air, water, and lubricant based on the condition of the ground be drilled. The operator utilizes the radio transmitter 42 to operate the flow control assembly 89 to permit the flow of compressed air through the power pack 12 and to, thereby, activate the hammer 18 of the drill 14. When additional lengths are added to the drill string 16, the flow of compressed air is stopped by the operator by operating the flow control assembly 89, via the radio transmitter 42, to stop the flow through power pack 12.

The flow of the mixture from the power pack 12 is used to both operate the hammer 18 to work the bit 26 against the ground structures and to clean the bit face 30 and clear the bore 98 during the operation of the drill 14 to provide improved efficiency over other horizontal drilling systems known in the art.

Figure 3:
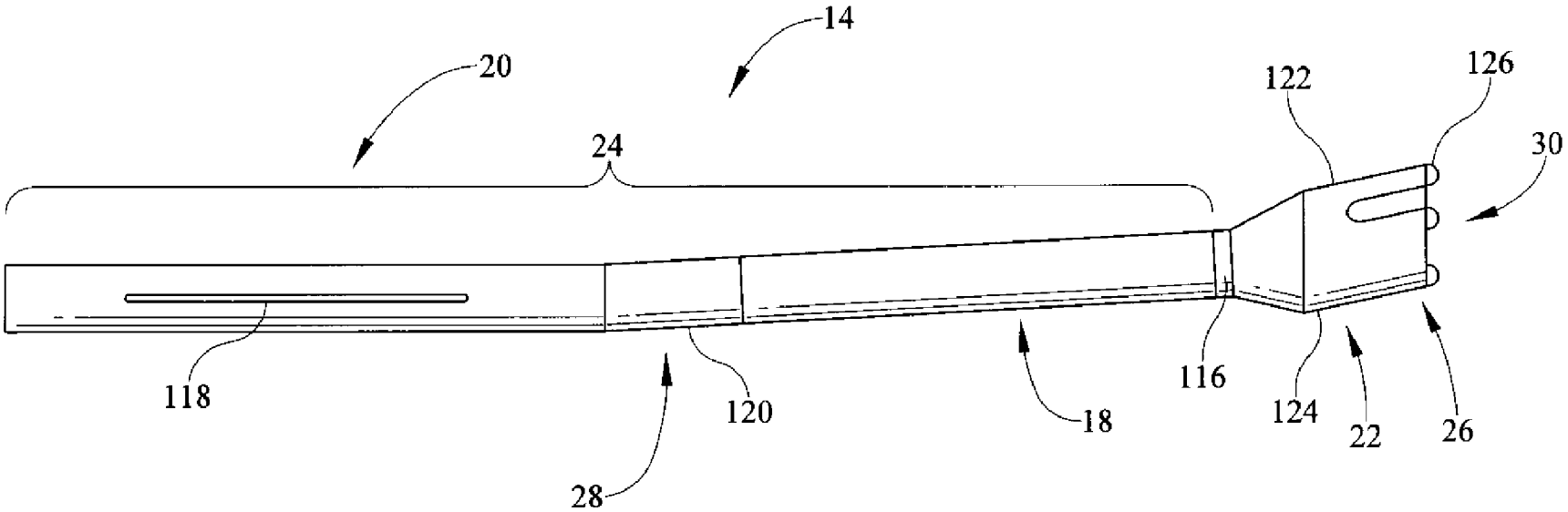
FIG. 3 is a perspective view of a drill of the horizontal drilling system of FIG. 1.

Referring now to FIG. 3, the drill 14 includes the drill body 24 and the drill head 22. The drill body 24 includes the back body 20, the hammer 18, and a connector 28 which couples the back body 20 and the hammer 18 so that the longitudinal axes of the back body 20 and the hammer 18 intersect at an angle of about 178 degrees. It is this angle, which facilitates steering of the drill 14 during operation. In other embodiments, the angle may be decreased depending on the size of the back body 20 and hammer 18. The drill head 22 includes the bit 26 which has a larger diameter than the diameter of the back body 20 and the hammer 18. The length of the drill body 24 is such that when the drill body 24 is rotated 360 degrees, the path of an outer edge 120 of the connector 28 is within the diameter of a bore formed by the drill head 22. This permits the drill 14 to be rotated as the hammer 18 is activated to maintain a relatively straight bore 98. If a turn is necessary, the drill 14 may be positioned so that the bit face 30 is perpendicular to the desired path so that the bit 26 works the ground in the direction desired. The bit 26 is formed such that surfaces 122 and 124 provide proper relief during the turn. Once the new direction is determined, the drill 14 may be retracted slightly and rotated such that the bore 98 is formed with a circular cross section as the drill 14 follows the new path. The surface 124 of the bit 26 rests against the wall of the bore 98 formed by a leading edge 126 of the bit during turn. This allows the leading edge 126 to be rotated 180 degrees with the wall of the bore 98 serving to guide the bit 26 while the remainder of the bore 98 is opened on the new path. During this operation, the bit 26 forms the bore 98 such that the drill body 24 has sufficient relief to prevent binding against the bore 98 wall during the turn.

Figure 4:
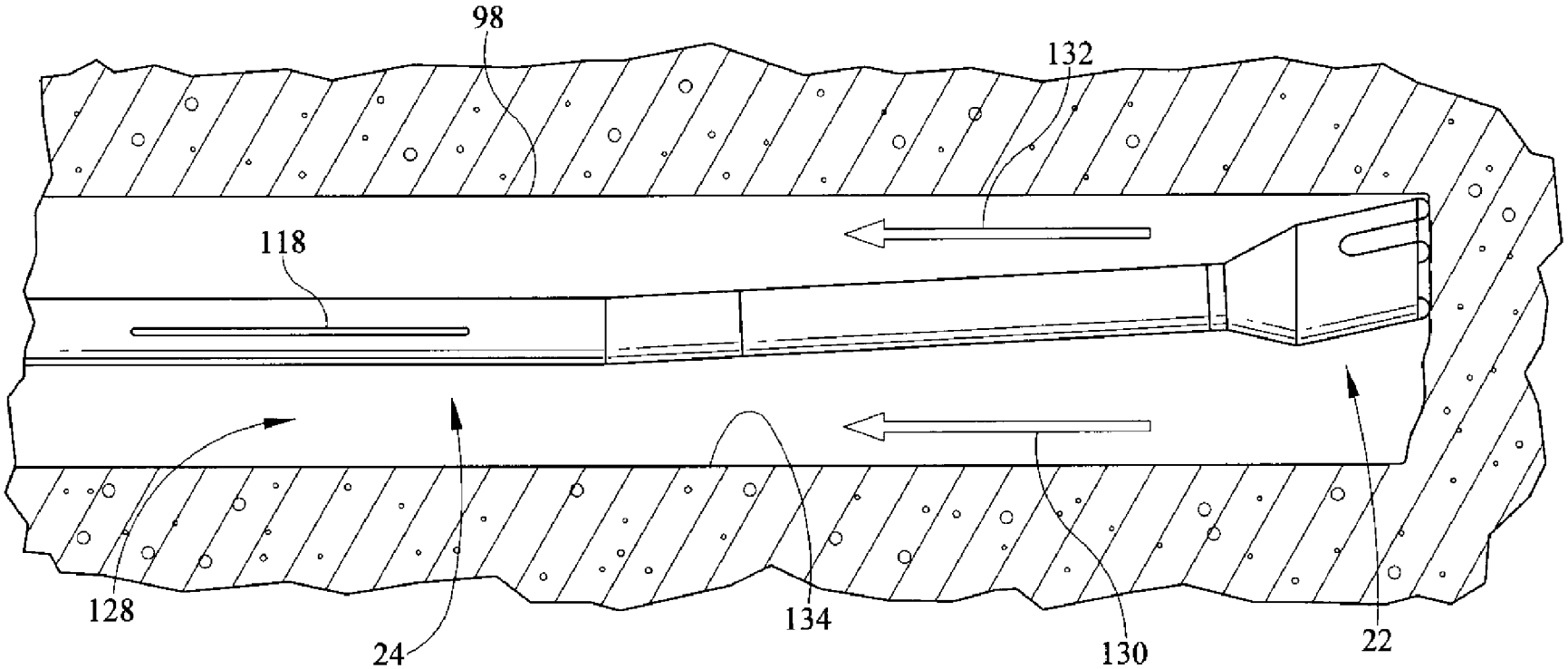
FIG. 4 is a perspective view of the drill of FIG. 3 positioned in a bore formed in the earth.
Figure 5:
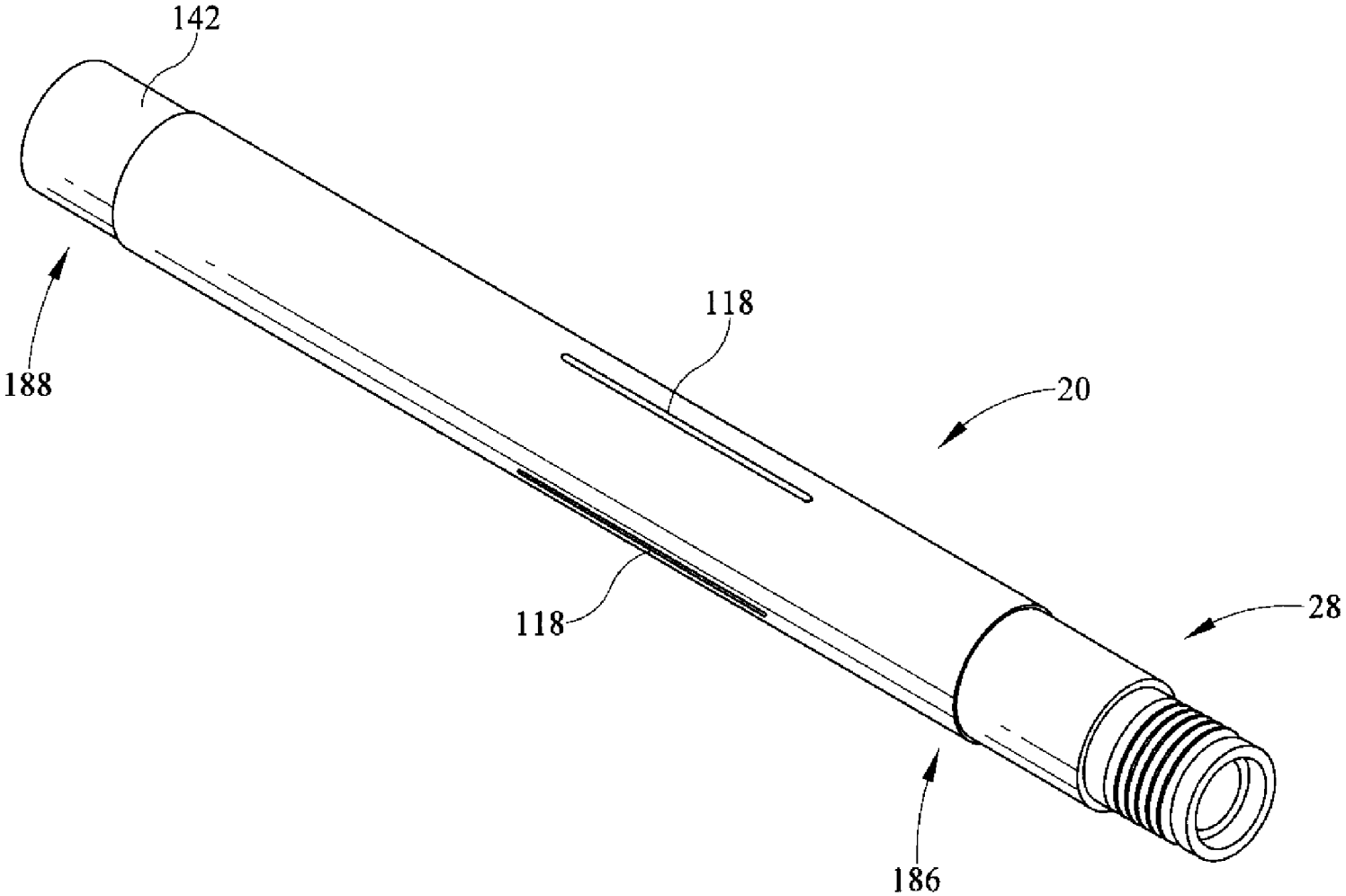
FIG. 5 is perspective view of a portion of the drill of FIGS. 3-4.
Figure 6:
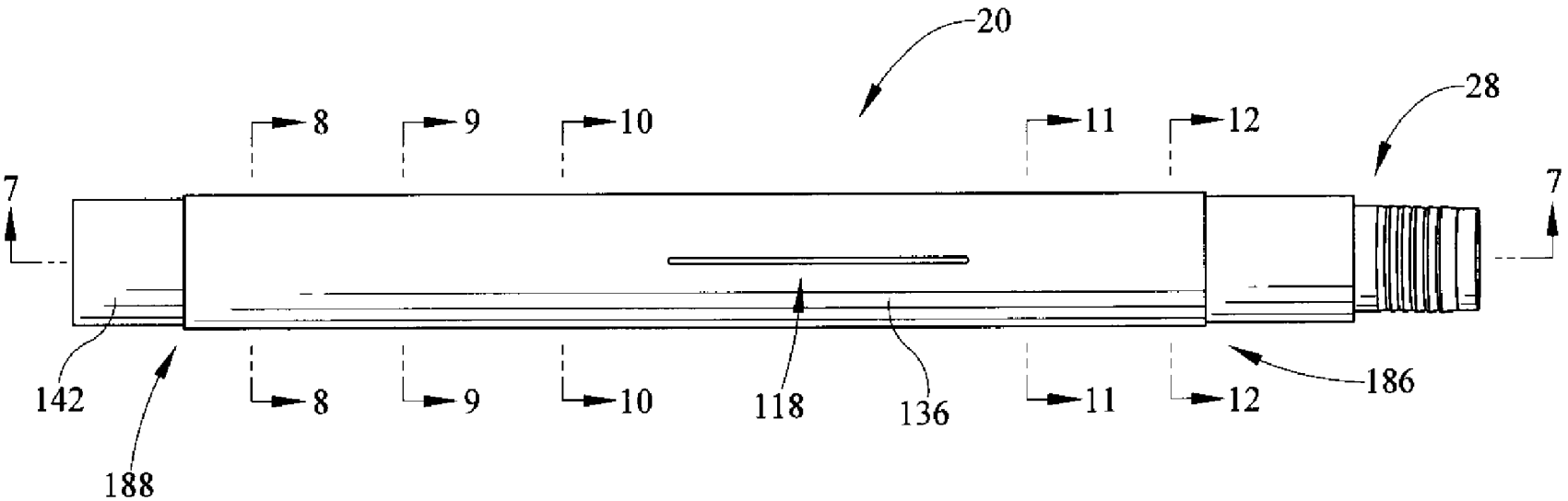
FIG. 6 is a plan view of the portion of the drill shown in FIG. 5.
Figure 7:
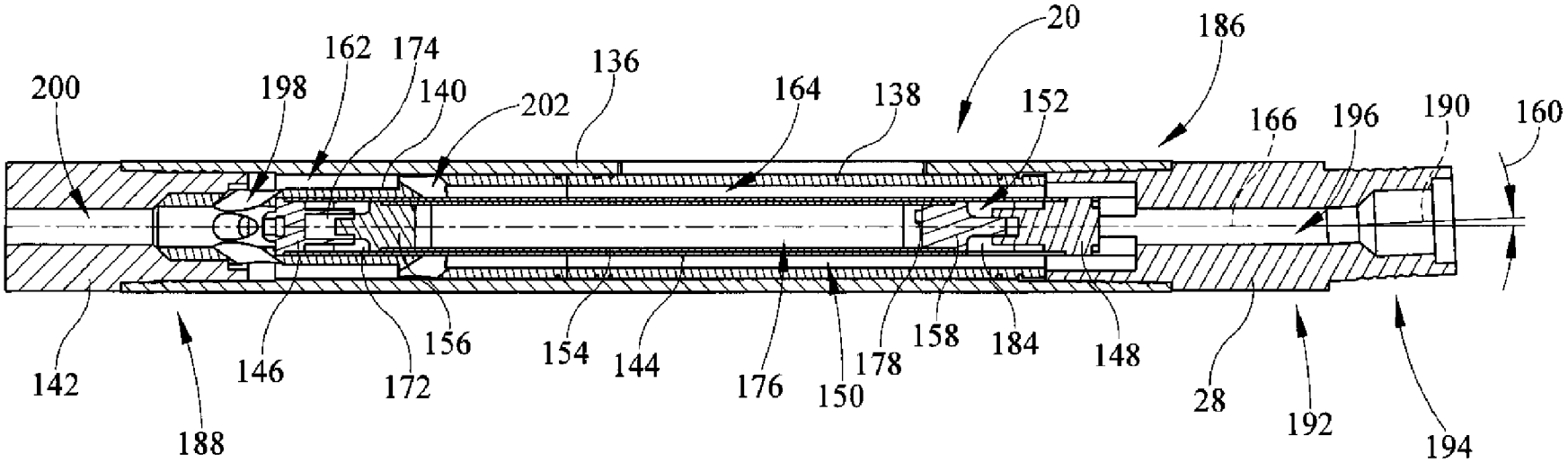
FIG. 7 is a cross-sectional view of the portion of the drill shown in FIG. 6, the cross-sectional view taken along lines 7-7.
Figure 8:
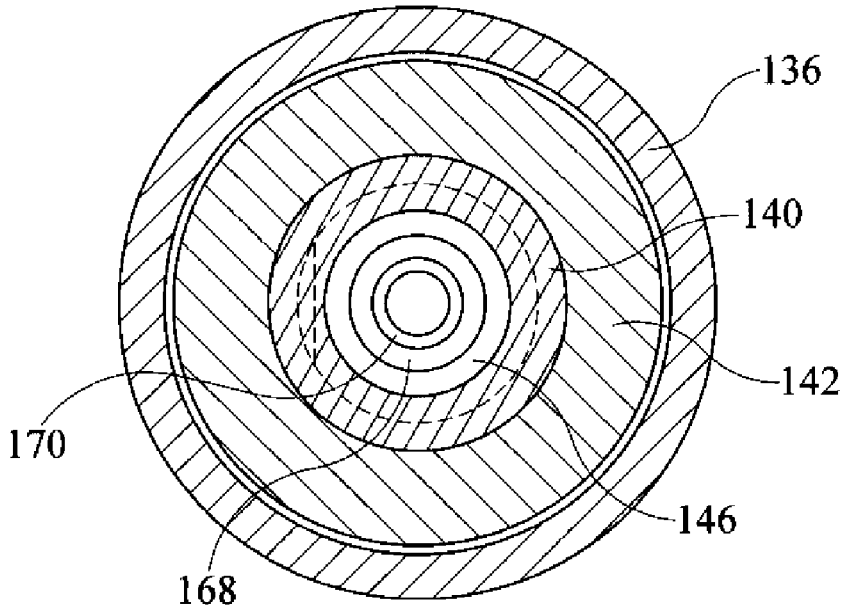
FIG. 8 is a cross-sectional view of the portion of the drill shown in FIG. 6, the cross-sectional view taken along lines 8-8.
Figure 9:
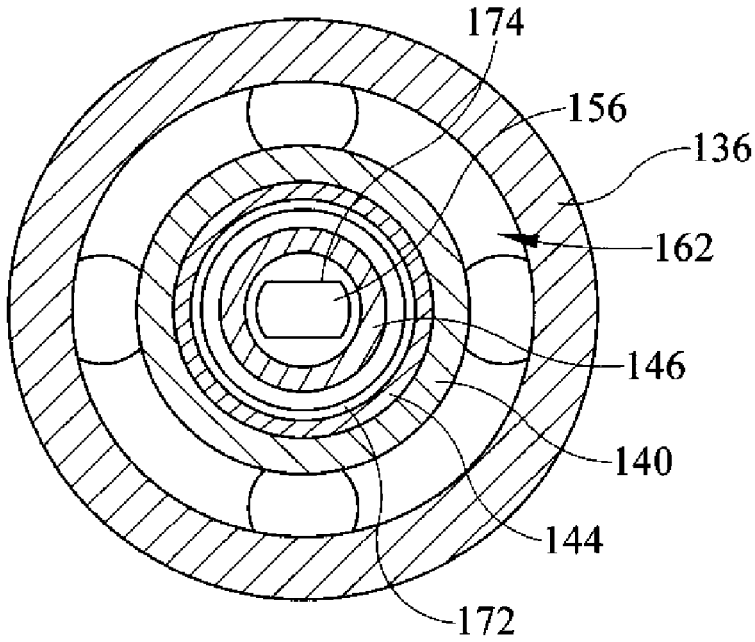
FIG. 9 is a cross-sectional view of the portion of the drill shown in FIG. 6, the cross-sectional view taken along lines 9-9.
Figure 12:
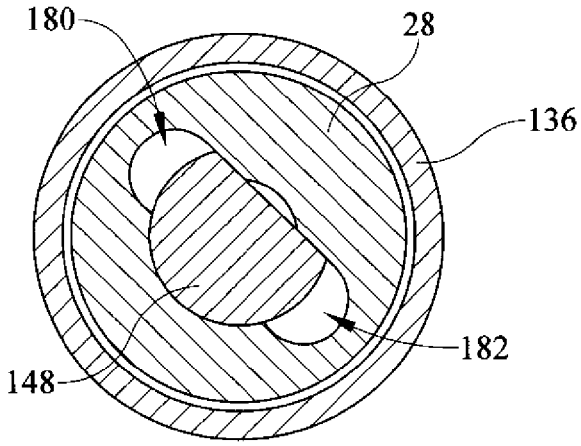
FIG. 12 is a cross-sectional view of the portion of the drill shown in FIG. 6, the cross-sectional view taken along lines 12-12.
Figure 10:
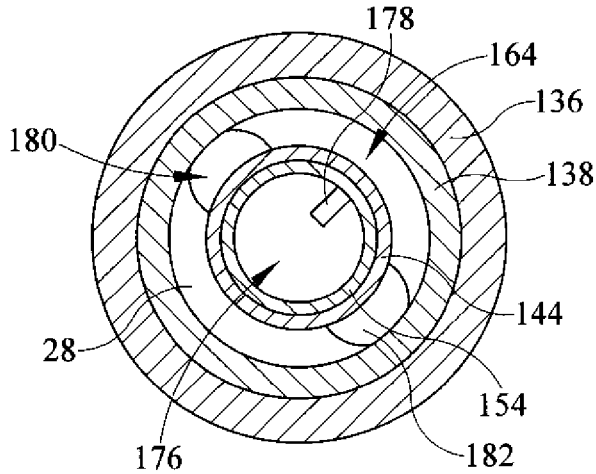
FIG. 10 is a cross-sectional view of the portion of the drill shown in FIG. 6, the cross-sectional view taken along lines 10-10.
Figure 11:
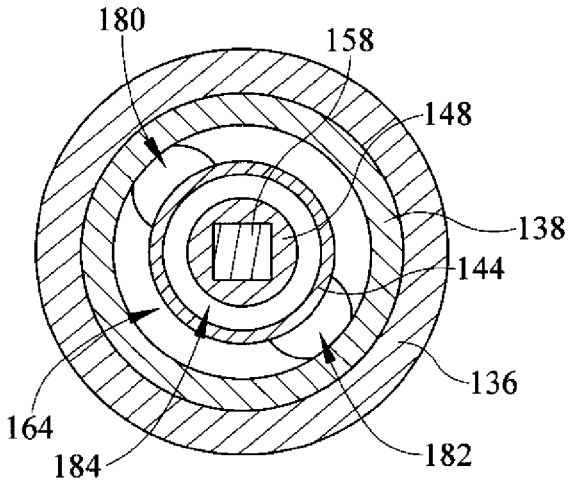
FIG. 11 is a cross-sectional view of the portion of the drill shown in FIG. 6, the cross-sectional view taken along lines 11-11.
Figure 13:
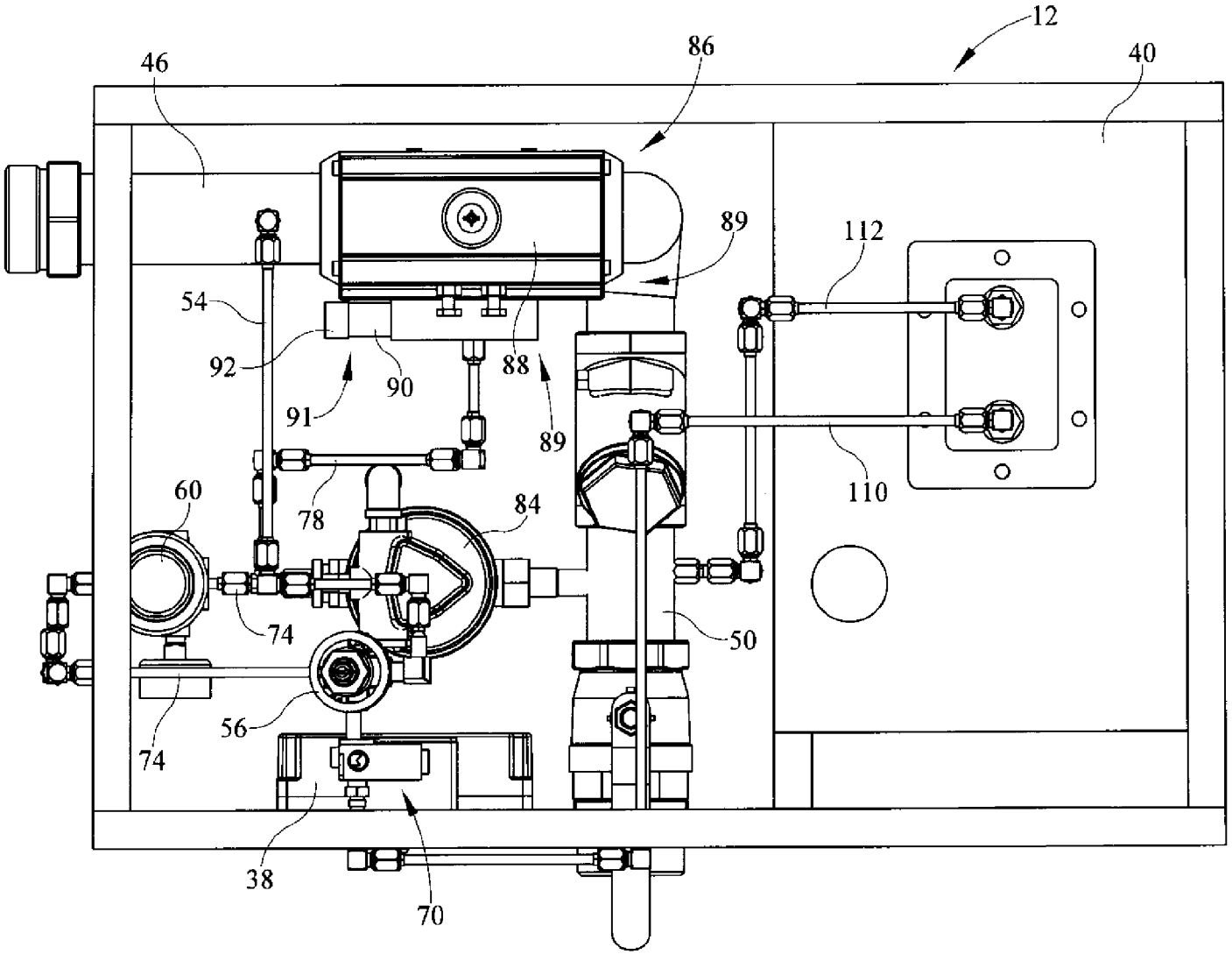
FIG. 13 is a top plan view of the power pack of FIG. 1.
Figure 14:
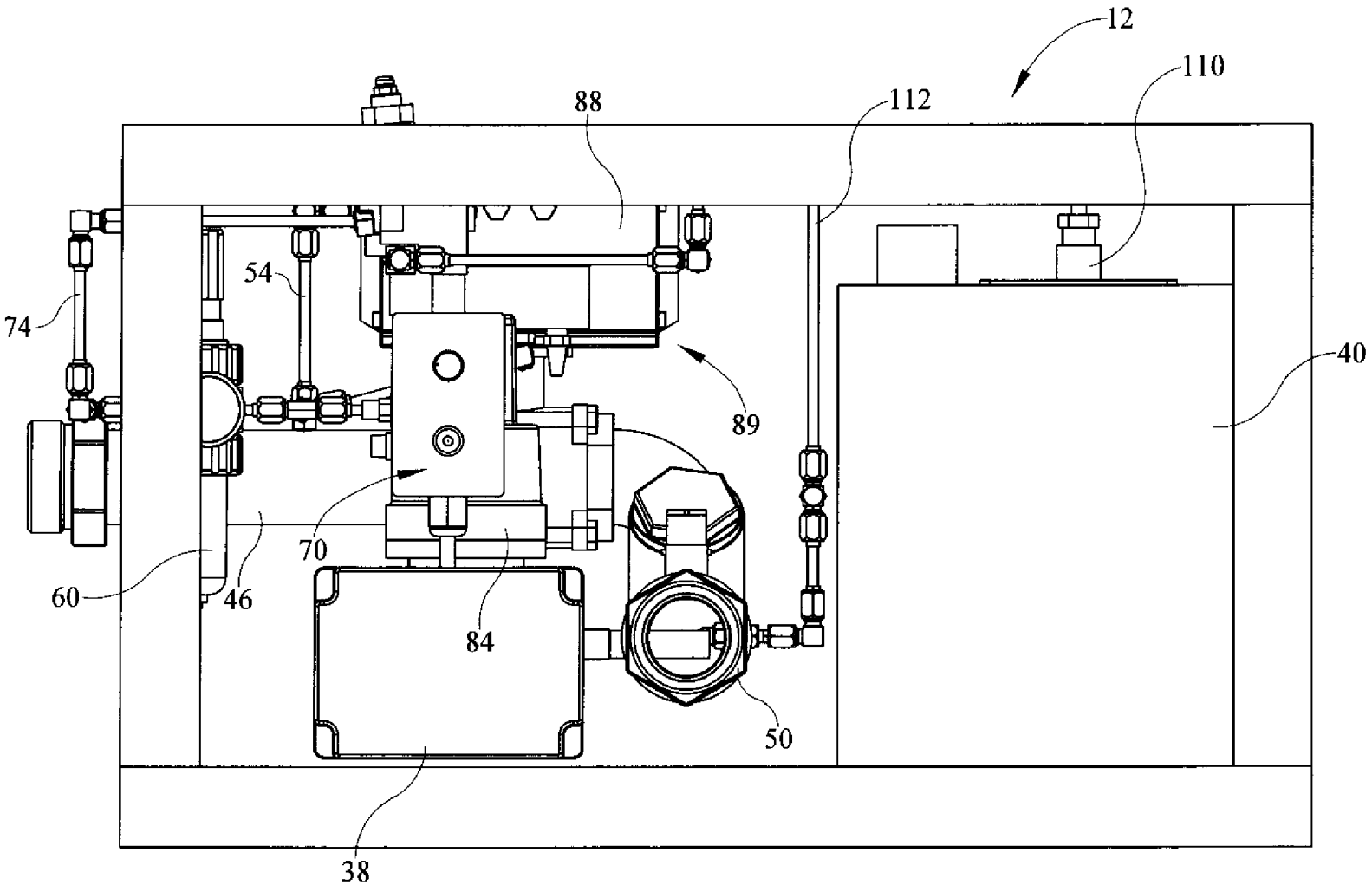
FIG. 14 is a front plan view of the power pack of FIG. 1.
Figure 15:
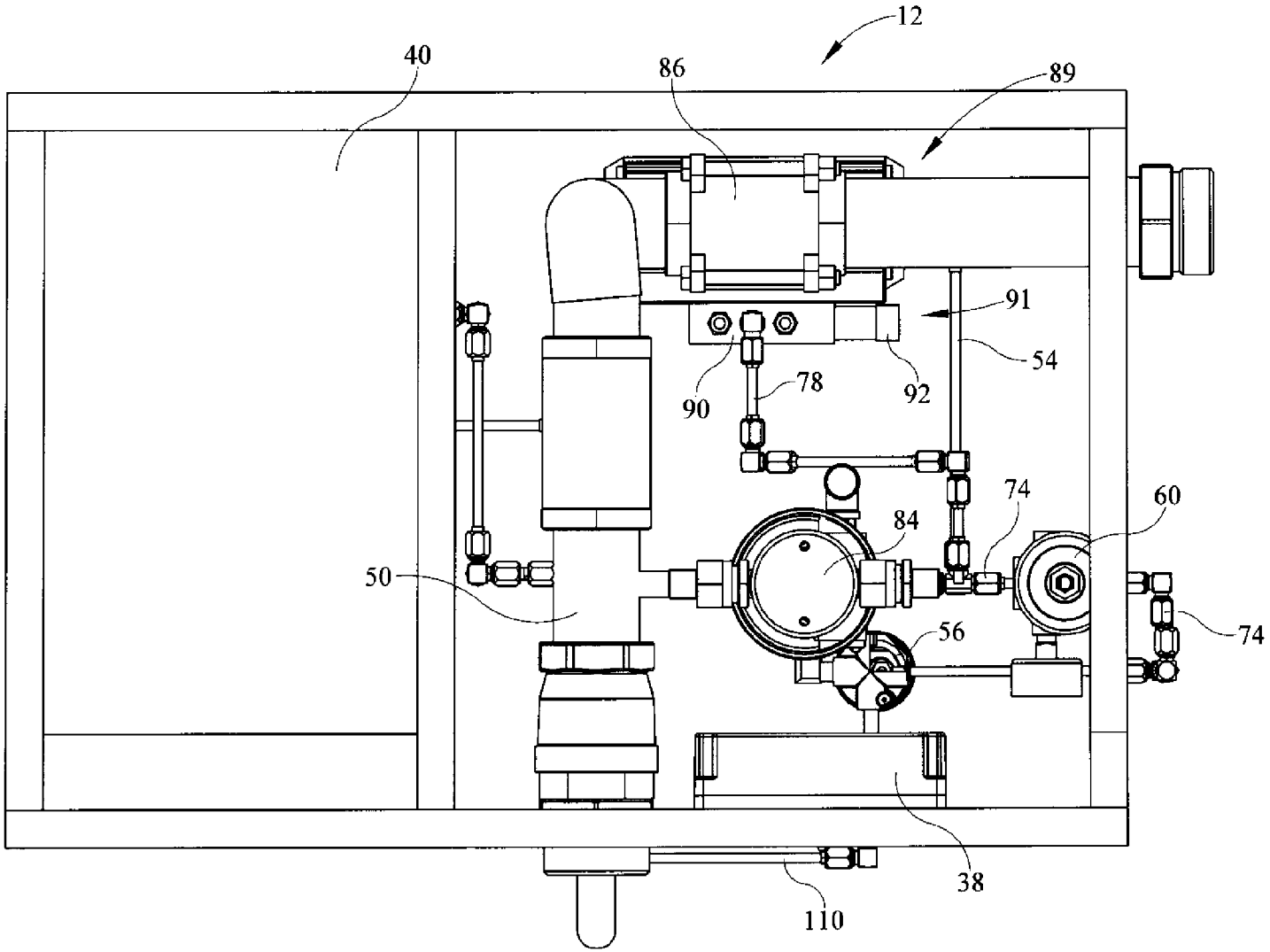
FIG. 15 is a bottom view of the power pack of FIG. 1.

The relief provided by the size and shape of the bit 26 facilitates the removal of cuttings from the bore 98 during operation of the horizontal drilling system 10. Specifically, the cuttings are forced off from the bit face 30 and the relief space 128 between the drill 14 and a cylindrical wall 134 of the bore 98 permits the mixture of air, water, and lubricant to flow back through the bore 98 as indicated by the arrows 130 and 132 in FIG. 4, thereby flushing the cuttings from the bit face 30.

The flow of the mixture travels through the drill string 16 as is known in the art. In the illustrative embodiment, the hammer 18 is a G-Force QL-40 SHANK hammer available from America West Drilling Supply of Sparks, Nev. In the illustrative embodiment, the hammer is an impact hammer. The term actuation mechanism as it relates to the hammer 18 should be understood to include mechanical, pneumatic, hydraulic, and vibratory mechanisms for working the ground and other structures during operation of the horizontal drilling system 10. The bit 26 is a proprietary configuration of Pioneer One, Inc., Mooresville, Ind. The hammer 18 has an outside diameter of approximately 4 inches. The bit 26 has a radius of about 2.75 inches from a central axis to the leading edge 126. Thus, a fully revolved bit 26 will form an annular clearance space of approximately 0.75 inches. In cross-section, the drill body 24 will only occupy about 50% of the diameter of the bore, thereby providing considerable clearance for the removal of cuttings. It should be understood that in other embodiments, other sizes of drill body and drill heads may be utilized within the scope of this disclosure.

The back body 20 is a proprietary configuration of Pioneer One, Inc. and is configured to facilitate the flow of the mixture through the back body 20 while supporting the sonde 104 during the drilling operation. Referring to FIGS. 5-12, the structure of the sonde housing 104 is disclosed in detail. The back body 20 includes an outer case 136. The connector 28 is threaded into the outer case 136 at a front end 186 of the back body 20. The back body 20 also includes a back head 142 threaded into the outer case 136 at a rear end 188 of the back body 20. The other components of the back body 20 are captured within the outer case 136 and held in place by the clamping action of the connector 28 and back head 142. The back body 20 further includes tube assembly 150 which encases a sonde housing 152. The tube assembly 150 is keyed to the connector 28. The sonde housing 152 is keyed to the outer tube 144. A sonde (not shown) positioned in the sonde housing 152 engages a key 178 within a space 176 of the sonde housing 152 so that the rotational position of the sonde is controlled through the keying of the sonde housing 152 to the tube assembly 150 and the keying of the tube assembly 150 to the connector 28.

The connector 28 includes a body 192 and a threaded stem 194 which extends from the body 192. The body 192 defines a longitudinal axis 166. The threaded stem 194 revolves about an axis 190 that deviates from axis 166 by an angle 160. In the illustrative embodiment, the angle 160 is about 2 degrees. Larger or smaller angles may be chosen depending on the length and diameter of the back body 20 and hammer 18, as well as the amount of offset in the This deviation facilitates the steering of the drill 14 as the drill 14 is rotated because the bit face 30 is not perpendicular to the axis 166 which is coincident with the axis of the back body 20. The sonde is keyed to the position of the bend created in the drill 14 by the angle 160. This permits the operator to identify the orientation of the drill 14 in the bore 98 during the drilling process.

The need to support the sonde in the back body 20 impedes the formation of a flow path for the mixture through the back body 20 to the hammer 18. The connector 28 is formed to include two passages 180 and 182 (seen in FIGS. 10-12) that are connected to a fluid channel 196 formed in the connector 28. The fluid channel 196 communicates with the compressed air input of the hammer 18 to cause the hammer 18 to reciprocate. By permitting sufficient flow to the hammer 18, the hammer 18 operates at higher pressure than prior art hammer drills, thereby increasing the rate of progress through the bore. In the illustrative embodiment, the hammer 18 operates at approximately 300 pounds per square inch with available flow through the back body 20.

The sonde housing includes a front housing end 158 and a rear housing end 156 each threaded into the ends of a housing tube 154. The key 178 is formed on the front housing end 158 and is positioned in a space 176 provided for the sonde.

The tube assembly 150 includes a front tube end 148 and a rear tube end 146 each of which are threaded into the ends of an outer tube 144. The front housing end 158 is keyed to engage the front tube end 148 to maintain the position of the key 178 relative to the front tube end 148. The front tube end 148 is keyed to engage the connector 28 to maintain the relationship of the tube assembly 150 to the connector 28.

A cover 138 and a spacer tube 140 are positioned within outer case 136 and are spaced apart from the tube assembly 150 to provide a flow path through the back body 20. The spacer tube 140 includes a four rear channels 198 that provide a flow path for the mixture from a fluid channel 200 formed in the back head 142. The fluid channel 200 receives mixture from the drill string 16 and the mixture passes through the rear channels 198 into a space 162 between the spacer tube 140 and the outer casing 136. The mixture then passes through four front channels 202 that permit the mixture to flow into an annular space 164 between the cover 138 and the outer tube 144. The mixture then passes through the passages 180 and 182 in the connector 28 to be communicated to the hammer 18 through the fluid channel 196.

The rear tube end 146 includes a receiver 168 having a threaded hole 170 which is engaged by a leading member of the drill string 16 to connect the drill 14 to the drill string 16. In the illustrative embodiment, the spacer tube 140, outer tube 144, sonde housing tube 154, and cover 138 are constructed of an abrasion resistant plastic material. In the illustrative embodiment, the remaining components are constructed of stainless steel.

Once the back body 20 is assembled, the hammer 18 and drill head 22 are attached. The drill head 22 is secured to the hammer 18 so that the leading edge 126 of the bit 26 is properly positioned relative to the bend formed by angle 160. Thus, the position of the bit 26 and bend formed by angle 160 are both keyed to the sonde so that an operator can continually monitor the path being formed by the drill 14. Once the hammer 18 is activated by the opening of the ball valve 86, the operator controls the progression of the formation of the bore 98 by advancing the drill string 16 from the horizontal drilling machine 32. The sonde provides signals 106 which are received the by sonde receiver 108 to provide an operator an indication of the location and orientation of the drill 14. The outer casing 136 is formed to include three longitudinal apertures 118 evenly spaced about circumference of the back body 20. These apertures 118 provide a path for the radio signal 106 to pass without being impeded by the metal of the outer casing 136.

Due to the high pressure operation of the hammer 18, clearing of the bit face 30 by the mixture, and the clearing of cuttings from the bore 98, the progression of the drilling of the bore 98 through homogeneous materials, such as limestone, for example, has resulted in up to an 80% reduction in the time required for formation of a bore 98.

Although certain illustrative embodiments have been described in detail above, variations and modifications exist within the scope and spirit of this disclosure as described and as defined in the following claims.

The invention claimed is:

1. A horizontal direction drilling system comprising a power pack coupled to a source of compressed air and a water reservoir, the power pack including (i) a controller, (ii) an air flow valve coupled to the controller and operable to control the flow of compressed air from the source of compressed air, (iii) an oiler driven by compressed air, the oiler operable to inject a predetermined quantity of lubricant into the flow of compressed air, and (iv) a pump driven by compressed air, the pump operable to inject a quantity of water from the water reservoir into the flow of compressed air such that the air, oil, and water form a mixture, wherein the controller is operable to vary the flow of compressed air through the power pack, and a steerable horizontal drill including an air powered reciprocating hammer, and a drill head, the steerable horizontal drill receiving the mixture to power the reciprocating hammer, wherein the drill head includes a drill face and the mixture exits the steerable horizontal drill through the drill face.

2. The horizontal drilling system of claim 1, wherein the system further includes a remote control transmitter and the power pack further includes a remote control receiver to receive control instructions from the remote control to vary the operation of the power pack.

3. The horizontal drilling system of claim 1, wherein the air flow valve comprises a ball valve.

4. The horizontal drilling system of claim 1, wherein the steerable drill comprises a back body and a connector coupling the back body to the hammer.

5. The horizontal drilling system of claim 4, wherein the steerable drill further comprises a position transmitter housing positioned in the back body.

6. The horizontal drilling system of claim 5, wherein the mixture flows through the back body to the hammer.

7. The horizontal drilling system of claim 4, wherein back body has a longitudinal axis, the hammer has a longitudinal axis, and the connector includes an offset such that when connected to the back body and the hammer, the longitudinal axis of the back body forms an angle with the hammer.

8. The horizontal drilling system of claim 7, wherein the angle is an angle of about two degrees.

9. The horizontal drilling system of claim 8, wherein the steerable drill further comprises a position transmitter housing positioned in the back body.

10. The horizontal drilling system of claim 9, wherein the mixture flows through the back body to the hammer.

11. The horizontal drilling system of claim 10, wherein the drill head includes a drill bit and the drill face is on the drill bit, and wherein the drill bit is formed so that a portion of the drill face is generally perpendicular to the longitudinal axis of the hammer and a first portion of the drill face extends away from the longitudinal axis of the hammer a distance greater than a second portion of the drill face so that the drill face is offset from the hammer.

12. The horizontal drilling system of claim 11, wherein the drill face has a maximum dimension from the longitudinal axis of the hammer that is greater than the radius of the hammer.

13. The horizontal drilling system of claim 12, wherein the position of a maximum offset dimension of the drill face, a point defined by the intersection of the longitudinal axis of the hammer and the longitudinal axis of the back body, and the orientation of a position transmitter positioned in the housing are all keyed such that the orientation of the position transmitter is indicative of the position of the offset drill face.

14. A power pack for powering a horizontal drill comprising a controller, an air flow valve coupled to the controller and coupled to a source of compressed air, the air flow valve movable between two positions to control the flow of compressed air, an air driven oiler injecting a predefined quantity of lubricant into the flow of compressed air, and an air driven pump injecting a predefined quantity of water into the flow of compressed air.

15. The power pack of claim 14, wherein the controller includes a radio receiver and controls the operation of the air flow valve based on instructions received by the radio receiver.

16. The power pack of claim 15, wherein the oiler comprises a positive displacement pump.

* * * * *